US007458848B2

(12) United States Patent
Nakano

(10) Patent No.: US 7,458,848 B2
(45) Date of Patent: Dec. 2, 2008

(54) CONNECTOR

(75) Inventor: Hiroshi Nakano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/897,163

(22) Filed: Aug. 29, 2007

(65) Prior Publication Data

US 2008/0057796 A1 Mar. 6, 2008

(30) Foreign Application Priority Data

Aug. 30, 2006 (JP) ..... 2006-234220

(51) Int. Cl.
*H01R 13/60* (2006.01)

(52) U.S. Cl. ..... 439/570

(58) Field of Classification Search ..... 439/570, 439/562, 563, 566, 79, 939
See application file for complete search history.

(56) References Cited

U.S. PATENT DOCUMENTS 5,232,379 A * 8/1993 Lai ..... 439/570
6,012,949 A 1/2000 Lok
6,227,907 B1 * 5/2001 Wu et al. ..... 439/570
6,280,247 B1 * 8/2001 Wu et al. ..... 439/570
6,361,332 B1 3/2002 Froude et al.
6,471,544 B1 * 10/2002 Huang ..... 439/567
6,475,001 B2 * 11/2002 Ohbayashi et al. ..... 439/83
7,086,895 B1 8/2006 Ting
7,134,910 B2 11/2006 Nakano et al.
7,320,618 B2 * 1/2008 Tsai ..... 439/541.5
2006/0116020 A1 6/2006 Ono et al.
2006/0121780 A1 6/2006 Nakano

* cited by examiner

*Primary Examiner*—Neil Abrams
*Assistant Examiner*—Phuong Nguyen
(74) *Attorney, Agent, or Firm*—Gerald E. Hespos; Anthony J. Casella

(57) ABSTRACT

A circuit board connector has a fixing member (20; 32; 42; 52) for a housing (10) on a circuit board (K). Engaging portions (24) of the fixing member (20; 32; 42; 52) are bent to increase the areas of engaging surfaces (25) in the thickness direction (TD). Thus, contact areas between the engaging portions (24) and restricting surfaces (14) of the housing (10) increase, and forces acting on the contact surfaces are distributed. Accordingly, even if large separating forces repeatedly act on a housing (10), damage and to the engaging portions (24) and restricting surfaces (14) can be prevented.

14 Claims, 7 Drawing Sheets

CONNECTOR

BACKGROUND OF THE INVENTION

1. Field of the Invention

The invention relates to a connector to be mounted on a device, particularly to a circuit board connector.

2. Description of the Related Art

U.S. Pat. No. 7,134,910 discloses a circuit board connector with a housing that is fixed to a surface of a circuit board. The housing has a front end configured for receiving a mating connector. Fixing brackets are formed from a metal plate and are mounted in the housing. The circuit board connector is placed on the circuit board and the bottom ends of the fixing brackets are soldered to the circuit board to fix the connector to the circuit board.

The fixing brackets are inserted from above into mount grooves formed in opposite side surfaces of the housing and are mounted so that the plate surfaces thereof extend along the side surfaces of the housing. The width of upper ends of the fixing brackets in forward and backward directions exceeds the width of lower parts of the fixing brackets. The wide upper ends of the fixing brackets define engaging portions with bottom edges that bulge out in forward and backward directions. The bottom edges of the engaging portions contact restricting surfaces formed in the mount grooves to restrict downward displacement of the fixing brackets in the mount grooves of the housing.

The circuit board connector is used with a mating connector, and a wiring harness may be drawn out from the mating connector. The wiring harness may be shaken up and down during use of the circuit board connector, and forces resulting from such upward and downward shaking can be transmitted to the housing of the circuit board connector via the mating connector. An upward force to separate the housing from the circuit board may repeatedly act on the housing. Accordingly, to improve the durability of the circuit board connector, it is essential to improve durability against the separating forces.

In the construction described above, a separating force exerted on the housing urges the restricting surfaces of the housing against the engaging portions of the fixing brackets. The parts of the engaging portions that are contacted by the restricting surfaces are bottom edges of plate members. Thus, contact areas between the engaging portions and the restricting surfaces are not very large, and large stresses are generated on the contact surfaces by the contact of the engaging portions and the restricting surfaces. A circuit board connector capable of enduring use under a severe environment, such as vibration over a long time, must prevent the engaging portions and restricting surfaces from being damaged or broken by separating forces that act repeatedly on the housing.

The invention was developed in view of the above situation, and an object thereof is to provide a connector to be mounted to or on a device having an improved durability against forces acting on a housing to separate the housing from the device.

SUMMARY OF THE INVENTION

The invention relates to a connector to be connected to a device such as a circuit board. The connector comprises a housing that can be connected with a mating connector. At least one fixing member made of a metallic plate material is mountable into a mount groove formed in the housing. The fixing member has a bottom end to be fixed to a device, such as a circuit board. At least one engaging portion is formed on the fixing member and at least one restricting surface is provided in the mount groove. The restricting surface contacts the bottom end of the engaging portion along the insertion direction to restrict a displacement of the engaging portion in the insertion direction. The engaging portion is bent, folded or shaped to increase the area of the bottom end thereof in the thickness direction.

The contact area of the engaging portion and the restricting surface is increased by the bending, folding or shaping of the engaging portion. Thus, forces on the contact surface are distributed. Accordingly, even if large separating forces repeatedly act on the housing, damage to the engaging portion or the restricting surface is less likely, and durability against separating forces can be improved.

The area of the bottom end of the engaging portion could be increased in the direction of the plate surface of the engaging portion and along the side surface of the housing by increasing the projecting distance of the engaging portion instead of bending the engaging portion. However, the side surface of the housing would have to be enlarged in forward and backward directions. Accordingly, the area of the bottom end is increased in the thickness direction of the engaging portion by bending or folding the engaging portion. Therefore the housing need not be enlarged in forward and backward directions. Accordingly, the contact area of the engaging portion and restricting surface can be increased and the durability of the circuit board connector can be improved without enlarging the housing.

The at least one mount groove preferably is formed in a side surface of the housing so that the plate surface extends substantially along the side surface of the housing.

At least one engaging portion preferably is formed on the fixing member and has a plate surface projecting along the side surface of the housing at least from one of the front and rear edges of the fixing member.

At least one solder portion preferably is provided at the bottom end of the fixing member projects at an angle to the side surface of the housing.

The fixing member preferably is fixed to the device by soldering or welding the solder portion to the outer surface of the device.

The engaging portion preferably is bent at a projecting end position thereof towards a projecting side of the fixing member, with at least one bent part thereof located more inward than the position of the projecting end of the fixing member. Thus, the dimension of the entire fixing member in a direction normal to the side surface of the housing can be suppressed to that of a fixing member in which an engaging portion is not bent. This can maximally suppress the lateral enlargement of the circuit board connector.

The engaging portion preferably is folded back so that two parts are substantially in surface contact with each other. Thus, the area of the restricting surface can be made smaller as compared to the case where there is a clearance between the two parts while ensuring the same contact area of the engaging portion and restricting surface. Therefore, the space efficiency of the housing is better.

The engaging portion preferably is bent to be substantially L-, V or U-shaped.

At least one narrowing portion preferably is defined for narrowing the width of the respective mount groove in forward and backward directions. One or more retaining portions of the fixing bracket preferably bite gradually in narrowing portions of the mount grooves when the fixing bracket is inserted into the mount grooves for holding the fixing bracket in the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A circuit board connector according to a first embodiment of the invention is illustrated in FIGS. 1 to 5 and is identified generally by the numeral 1. The circuit board connector 1 is mountable to the upper surface of an electric or electronic device, such as a circuit board K, and an unillustrated mating connector is fittable therein from the front (right side in FIG. 1).

The circuit board connector 1 includes a housing 10 e.g. made of a synthetic resin (preferably a highly heat resistant synthetic resin) and has a substantially wide block shape. A rectangular tubular receptacle 10A is defined at a front part of the housing 10 serves as a receptacle 10A and can receive a mating connector. The mating connector is held in the receptacle 10A by unillustrated locking means.

Terminals 11 are held in the housing 10. The front end of each terminal 11 projects into the receptacle 10A and is connectable with a mating terminal (not shown) held in the mating connector. The rear end projects back from the rear end of the housing 10 and is bent substantially perpendicularly down so that a connecting portion 11A thereof can be soldered, welded or press-fit into connection with a conductor path (not shown) on the upper surface of the circuit board K (see FIG. 3).

Figure 1:
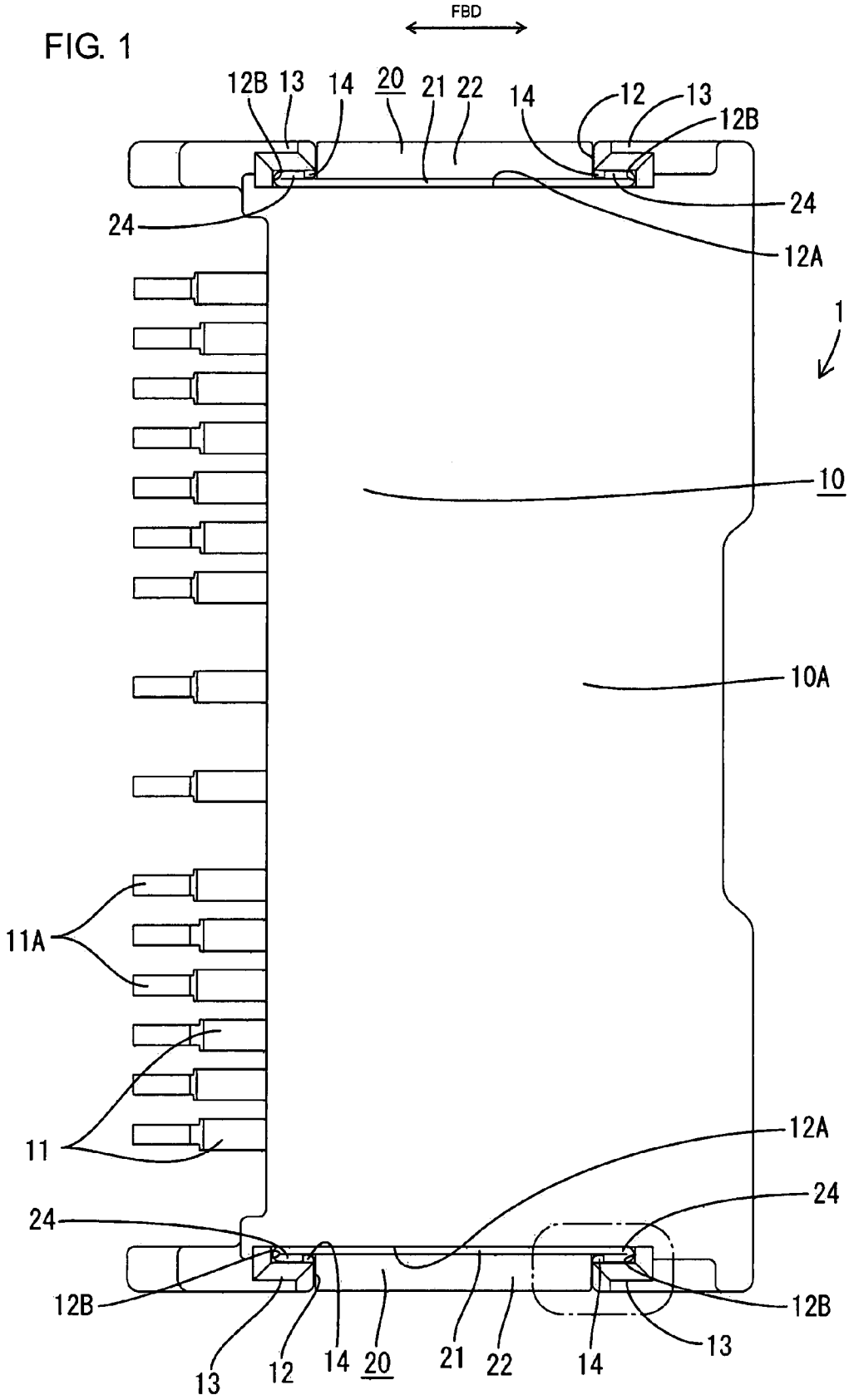
FIG. 1 is a plan view of a circuit board connector according to a first embodiment.

Mount grooves 12 are formed in the opposite left and right surfaces of the housing 10, as shown in FIG. 1. The left and right mount grooves 12 are formed by recessing the left and right surfaces of the housing 10 inward in areas from positions near the front end to positions near the back end, and open in both upper and lower surfaces of the housing 10. The fixing brackets 20 are insertable into the mount grooves 12 from above and along an insertion direction ID.

The fixing brackets 20 are for fixing the housing 10 onto the circuit board K, and are formed by punching or cutting a metal plate material into a specified shape and bending, folding and/or embossing the punched-out or cut material.

Each fixing bracket 20 is comprised of a main body 21 to be arranged substantially along an inner surface 12A of the mount groove 12, and a solder portion 22 that bulges out sideways substantially normal to the side surface of the housing 10 from the bottom end of the main body 12. The cross-sectional shape of the fixing bracket 20 in forward and backward directions FBD is substantially L-shaped.

Figure 2:
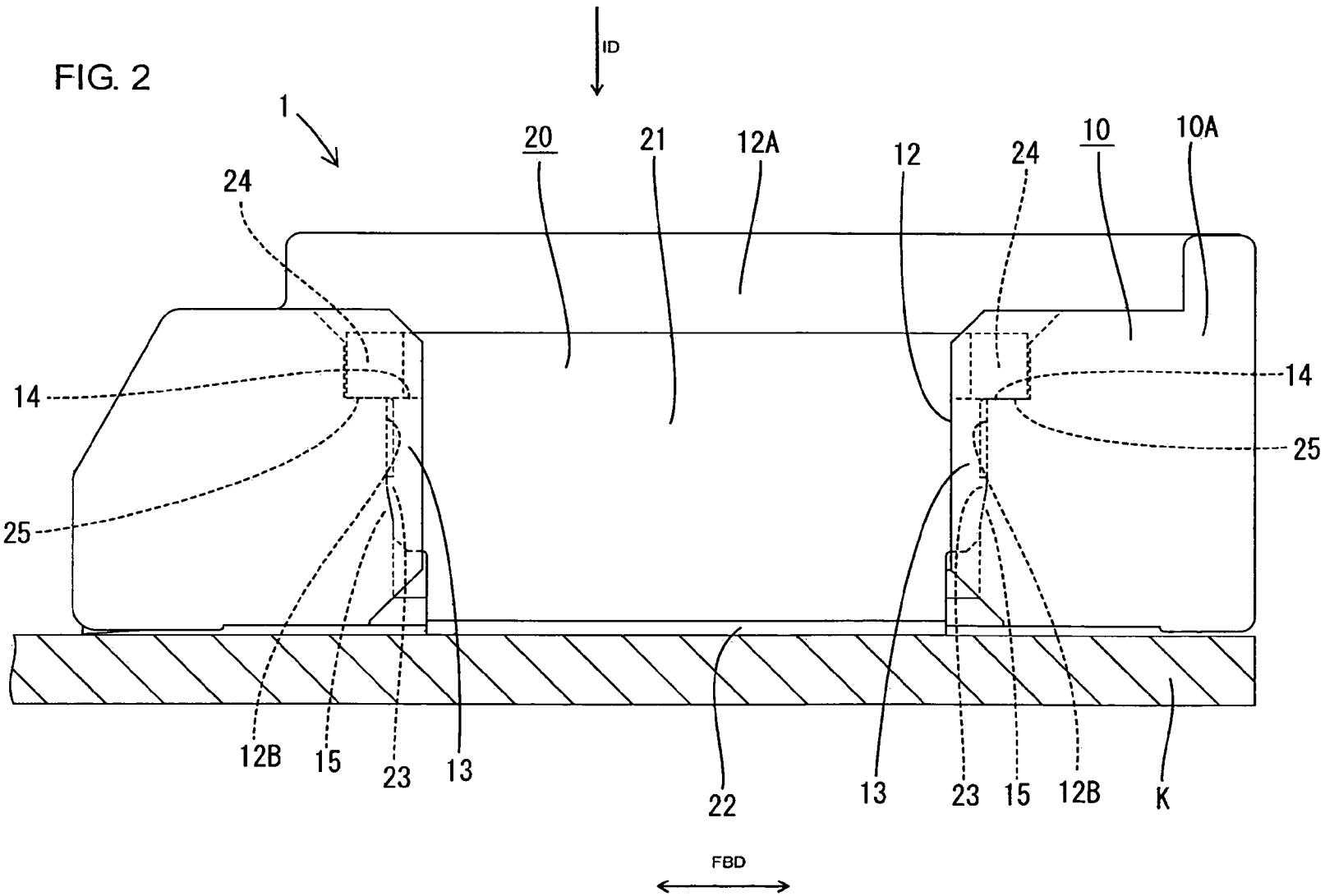
FIG. 2 is a side view of the circuit board connector.
Figure 3:
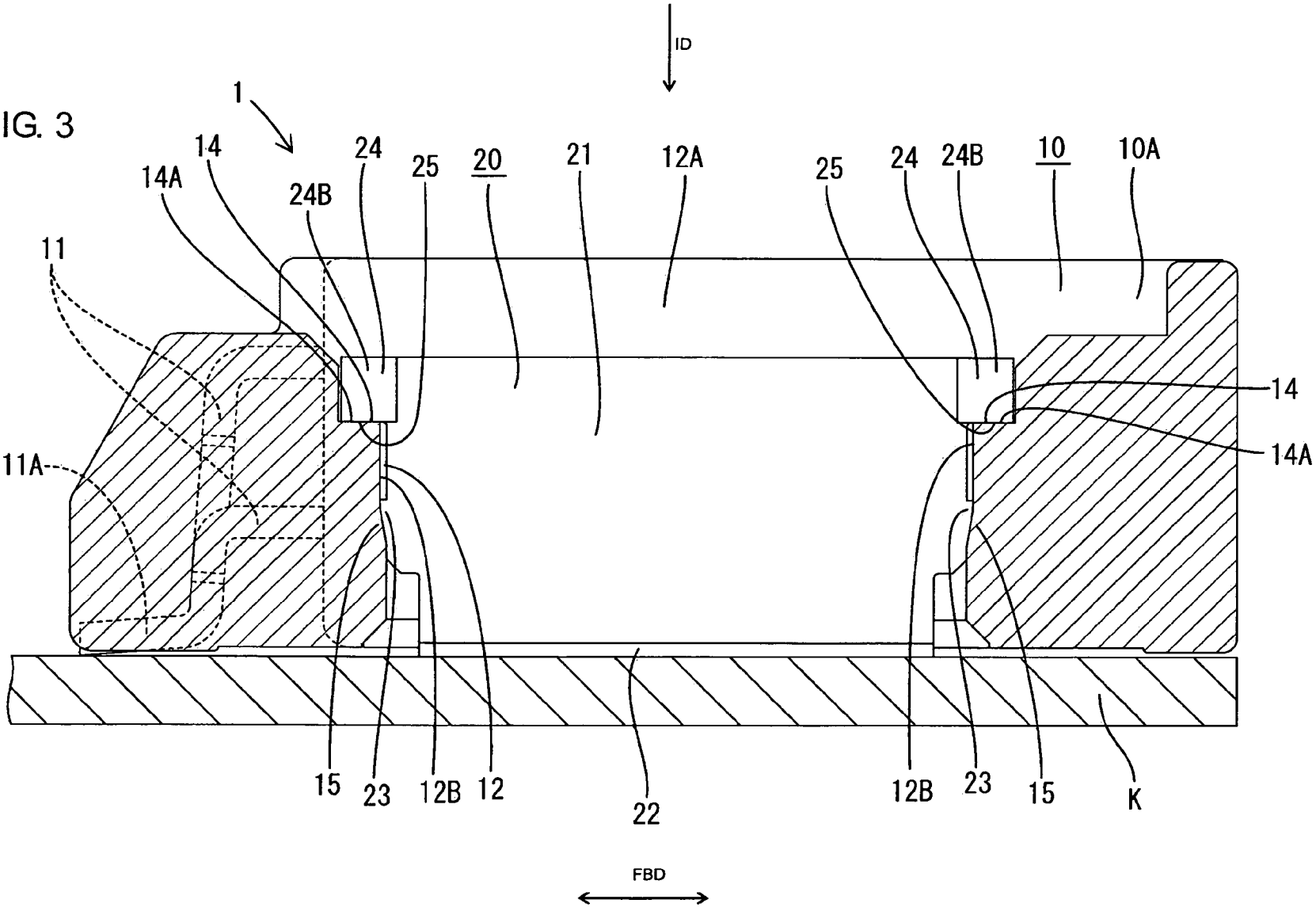
FIG. 3 is a side view in section of the circuit board connector showing a state where a fixing bracket is mounted in a mount groove.

As shown in FIGS. 2 and 3, the main body 21 is a flat substantially rectangular plate with a long dimension that extends in forward and backward directions FBD. The long dimension of the main body 21 substantially corresponds to the dimension of the inner surface 12A of the mount groove 12 in forward and backward directions FBD. The main body 21 is mounted closely mounted in the mount groove 12 so that almost no clearance is defined between the inner side surface of the main body 21 and the inner surface 12A of the mount groove 12.

The solder portion 22 is bent at the bottom end of the main body 21 to extend substantially normal to the plate of the main body 21. The lower surface of the solder portions 22 are substantially opposed to the upper surface of the circuit board K when the circuit board connector 1 is placed on the upper surface of the circuit board K. The circuit board connector 1 is fixed on the outer surface of the circuit board K by soldering the solder portions 22. The solder portions 22 are substantially rectangular and extend from the front to the rear ends of the ends of the main bodies 21 (see FIG. 4).

As shown in FIG. 3, front and rear retaining portions 23 project forward and backward from vertically intermediate positions of the front and rear edges of the main body 21. The retaining portions 23 bite in narrowing portions 15 of the mount grooves 12 as the fixing brackets 20 are mounted into the respective mount grooves 12 to retain the fixing brackets 20 in the mount grooves 12.

Figure 4:
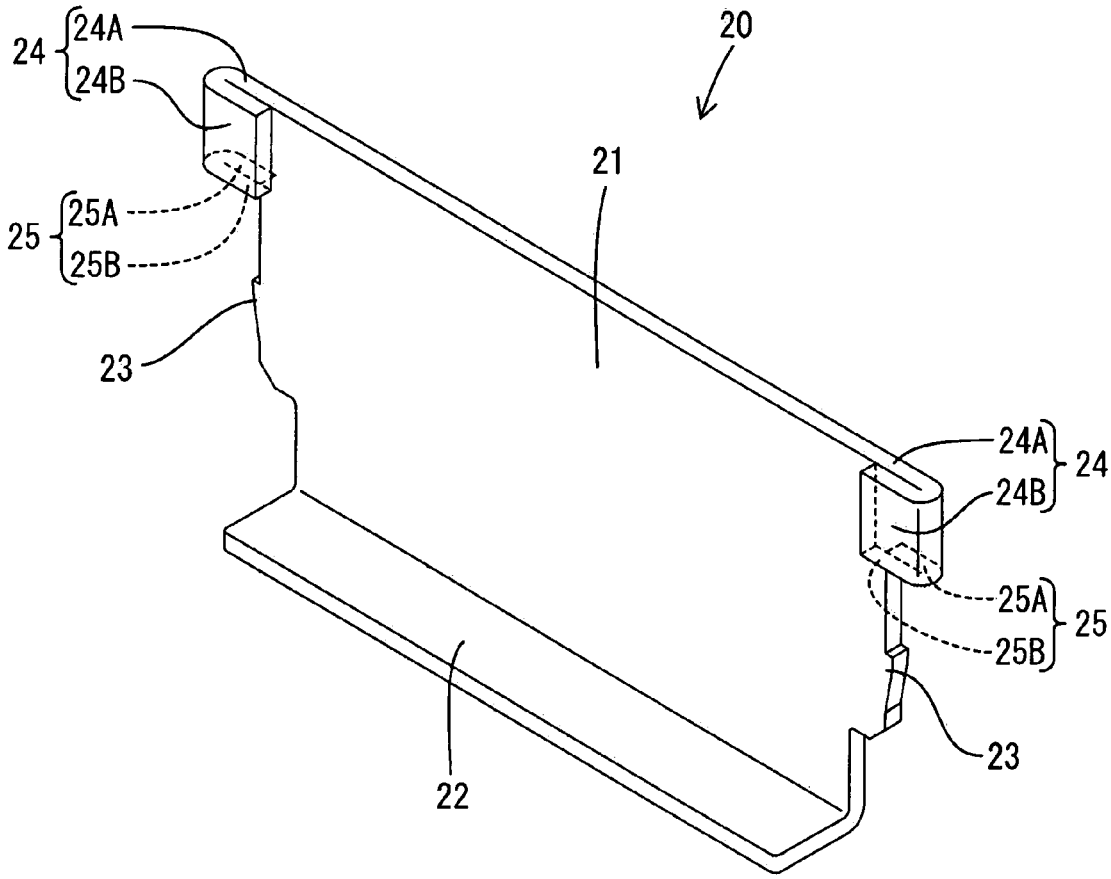
FIG. 4 is a perspective view showing the external configuration of the fixing bracket.

Substantially rectangular front and rear engaging portions 24 are provided at the upper end of the main body 21. The respective engaging portions 24 project forward and back from the front and rear edges of the main body 21, and are bent back at their projecting ends, as shown in FIG. 4. Each engaging portion 24 is comprised of a projection 24A and a folded portion 24B that is folded back from the projecting end and towards the corresponding solder portion 22. The plate surfaces of each projection 24A and the folded portion 24B closely contact each other to achieve a surface contact with each other over more than about 80%, more preferably over more than about 90%, and most preferably over more than about 95% of their respective surfaces. The leading ends of the folded portions 24B reach positions more inward than the front and rear edges of the 21. Thus, the engaging portions 24 have a thickness that is about twice the thickness of the metal plate material over substantially the entire width in the projecting direction. Therefore, the engaging portions 24 are thickened outward, as compared to other parts of the main body 21.

Engaging surfaces 25 are defined at the bottom ends of the engaging portions 24 and can contact restricting surfaces 14 of the mount grooves 12. Each engaging surface 25 is a combination of the inner engaging surface 25A of the projecting portion 24A and the outer engaging surface 25B of the folded portion 24B. The engaging surfaces 25 are substantially parallel to the outer surface of the circuit board K when the housing 10 is placed on the outer surface of the circuit board K. When viewed from below, the engaging surfaces 25 widen outward by as much as the outer engaging surfaces 25B, as compared to the other parts of the main bodies 21.

The entire thickness of each fixing bracket 20 is a sum of the thickness of the main body 21 and a dimension of the solder portion 22 from the plate surface of the main body 21 to the projecting end thereof.

The mount grooves 12 are recessed to a depth substantially equal to the entire thickness of the fixing brackets 20. As shown in FIG. 1, facing walls 13 project back and forward from the front and rear end surfaces of each groove 12 and face the inner surface 12A of each mount groove 12. The facing walls 13 are arranged substantially along the front and rear end edges of each mount groove 12. Clearances between the inner surface 12A of the mount groove 12 and the surface of the facing walls 13 opposed to the inner surface 12A are equal to or slightly larger than the thickness of the main body 21 of the fixing bracket 20.

Insertion grooves 12B are formed at the front and rear ends of each mount groove 12. The insertion grooves 12B have the front and rear end surfaces as bottom surfaces, and the inner surface 12A and facing walls 13 as side surfaces. The insertion grooves 12B extend substantially vertically along the front and rear end edges of the mount groove 12, and the front and rear end edges of the main body 21 are at inserted into the insertion grooves 12B. Hence, the fixing brackets 20 are held so as not to come out sideways from the mount grooves 12.

As shown in FIGS. 2 and 3, the restricting surfaces 14 are formed to extend substantially normal to the bottom surfaces of the insertion grooves 12B.

Figure 5A:
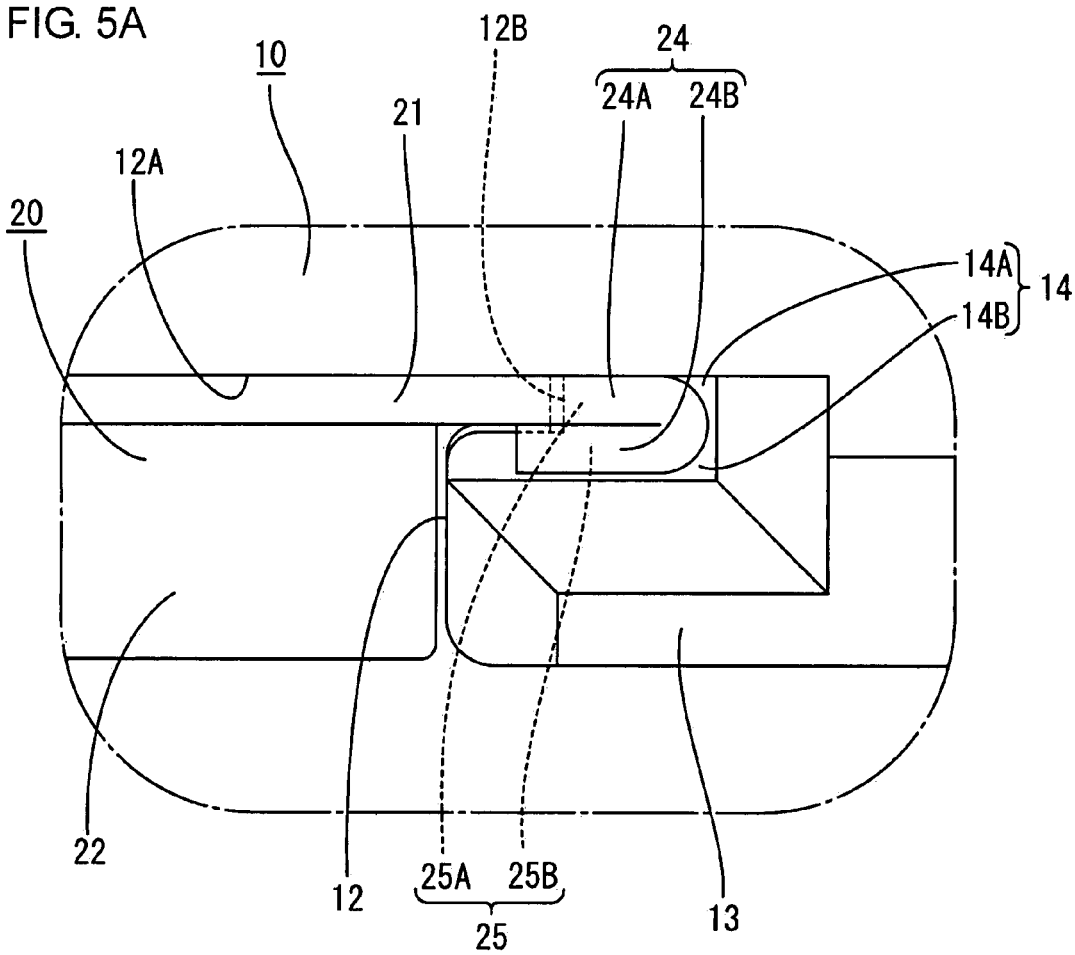
FIG. 5A is an enlarged view within a dashed-dotted line of FIG. 1
Figure 5B:
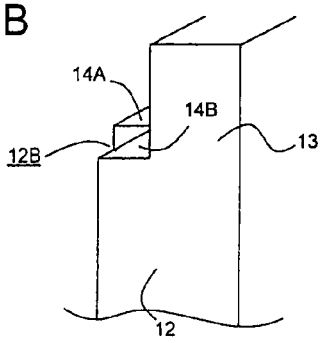
FIG. 5B is an enlarged perspective view thereof.

The restricting surfaces 14 are substantially parallel to the upper surface of the circuit board K when the housing 10 is placed on the upper surface of the circuit board K. As shown in FIG. 5, the restricting surfaces 14 extend from parts formed in the insertion grooves 12B to the inner parts of the facing walls 13. The parts of the restricting surfaces formed in the insertion grooves 12B are referred to herein as inner restricting surfaces 14A, and parts formed on the facing walls 13 are referred to herein as outer restricting surfaces 14B. Thus, the upper parts of the inner surfaces of the facing walls 13 are recessed more outward than the outer restricting surfaces 14B as can be seen in FIG. 5.

The width of the inner restricting surfaces 14A in inward and outward directions is substantially equal to the width of the insertion grooves 12B, and the width of the outer restricting surfaces 14B in inward and outward directions is substantially equal to the width of the inner restricting surfaces 14A. The width in inward and outward directions of each restricting surfaces 14 is a sum of the inner and outer restricting surfaces 14A, 14B and is slightly larger than twice the thickness of the fixing brackets 20. The outer restricting surfaces 14B, as viewed from above, project more forward or backward than the inner restricting surfaces 14A. Since the outer restricting surfaces 14B are formed on upper ends of the facing walls 13 the restricting surfaces 14 can expand laterally without laterally enlarging the housing 10.

The engaging surfaces 25 of the engaging portions 24 contact the restricting surfaces 14 of the respective mount grooves 12 to position the fixing brackets 20 along the inserting direction ID in the respective mount grooves 12. More specifically, the inner engaging surfaces 25B of the engaging surfaces 25 contact the inner restricting surfaces 14A and the outer engaging surfaces 25B contact the outer restricting surface 14B. A dimension of the outer restricting surfaces 14B in forward and backward directions FBD is larger than that of the outer engaging surfaces 25B in forward and backward directions FBD as shown in FIG. 5. Thus, the entire outer engaging surfaces 25B contact the outer restricting surfaces 14B.

As shown in FIG. 3, narrowing portions 15 are arranged deeper in the inserting direction ID than the restricting surfaces 14 and gradually narrow the width of the respective mount grooves 12 in forward and backward directions FBD. The retaining portions 23 gradually bite in the narrowing portions 15 as the fixing brackets 20 are inserted into the mount grooves 12, and hold the fixing brackets 20 at height positions in the left and right mount grooves 12 so that the lower surfaces of the solder portions 22 are slightly below the bottom surface of the housing 10. At this time, the solder portions 22 of the fixing brackets 20 are accommodated in the mount grooves 12 without laterally projecting from the side surfaces of the housing 10.

Cream solder can be applied to lands (not shown) on the upper surface of the circuit board K. The housing 10 then is placed on the circuit board K with the connecting portions 11A of the terminals 11 and the solder portions 22 of the fixing brackets 20 positioned on the corresponding lands. The circuit board K bearing the housing 10 then is transported in a reflow furnace (not shown) so that the cream solder melts to adhere to the connecting portions 11A of the terminals 11 and the solder portions 22 of the fixing brackets 20. The connecting portions 11A of the terminals 11 are connected electrically with the conductor paths of the circuit board K and the solder portions 22 of the fixing brackets 20 are fixed to the circuit board K when the solder is solidified. Thus, the circuit board connector 1 is fixed to the circuit board K.

The mating connector is connected with the circuit board connector 1 that has been fixed on the circuit board K, and the connected connectors are installed in a vehicle, an electric appliance or the like. A wiring harness drawn out from the mating connector moves up and down e.g. as the vehicle or the like vibrates. Forces resulting from the up and down movements are transmitted to the housing 10 of the circuit board connector 1 via the mating connector. Thus, forces to separate the circuit board connector 1 may act repeatedly on the housing 10 as the wiring harness moves up and down.

The restricting surfaces 14 of the mount grooves 12 are pressed against the engaging surfaces 25 of the engaging portions 24 every time the upward force acts on the housing 10. However, the engaging portions 24 are folded back so that the contact areas of the restricting surfaces 14 and engaging surfaces 25 are increased by the area of the outer engaging surfaces 25B as compared to conventional engaging portions having no folded portions 24B. The contact areas preferably are substantially twice as much as in the case where there are no folded portions 24B. If the same forces act on the contact surfaces, a pressing force per unit area of the contact surface is reduced to about half. As a result, stresses generated on the contact surfaces become smaller. Therefore, even under a severe environment e.g. where the wiring harness vibrates very much, the damage to the engaging portions 24 and the restricting surfaces 14 can be prevented, with the result that durability against the separating forces can be improved.

An attempt could be made to ensure the same contact areas as in this embodiment without bending the engaging portions 24. However, the projecting distance of the engaging portions 24 needs to be increased by as much as the dimension of the folded portions 24B in forward and backward directions FBD. Then, the dimension of the entire fixing brackets 20 in forward and backward directions FBD increases to twice the dimension of the folded portions 24B in forward and backward directions FBD since the projecting distance of the engaging portions 24 are increased at both the front and rear. This makes it necessary to expand the restricting surfaces 14 in forward and backward directions FBD by as much as the dimension of the folded portions 24B in forward and backward directions FBD, leading to the enlargement of the housing 10 in forward and backward directions FBD. However, since the engaging portions 24 are folded in this embodiment, the housing 10 need not be enlarged in forward and backward directions FBD. The smaller dimension of the housing 10 in forward and backward directions FBD is particularly advantageous in the case of strictly restricting a space to arrange the circuit board connector 1 for the high-density mounting of the circuit board K.

The folded portions 24B of the engaging portions 24 are folded back towards the side of the solder portions 22 and the thickness (dimension normal to the side surfaces of the housing 10) of the fixing brackets 20 are substantially the same as in the case where there are no folded portions 24B. This can prevent the circuit board connector 1 from being laterally enlarged.

The folded portions 24B and the projecting portions 24A closely contact each other with no significant clearance therebetween. Thus, the area of the restricting surfaces 14 is small as compared to the case where there is a clearance while ensuring substantially the same contact areas of the engaging surfaces 25 and the restricting surfaces 14. Thus, the outer restricting surfaces 14B of the restricting surfaces 14 can be formed on the upper parts of the facing walls 13, and the width of the housing 10 in the lateral direction (normal to the forward and backward directions FBD) is substantially the same as the conventional one in which the areas of the engaging surfaces are not expanded. Therefore, in this embodiment, the durability of the circuit board connector 1 is improved while the size of the circuit board connector 1 does not exceed the conventional circuit board connector.

As described above, the engaging portions 24 are folded so that the areas of the engaging surfaces 25 increase in the thickness direction TD of the engaging portions 24. Since the contact areas of the engaging portions 24 and restricting surfaces 14 are increased by this, forces acting on the contact surfaces are distributed to create less stress. Accordingly, even if large separating forces repeatedly act on the housing 10, the damage and the like of the engaging portions 24 and restricting surfaces 14 can be presented, with the result that durability against the separating forces can be improved. Further, improvement in the durability of this circuit board connector 1 is realized without enlarging the housing 10.

Figure 6:
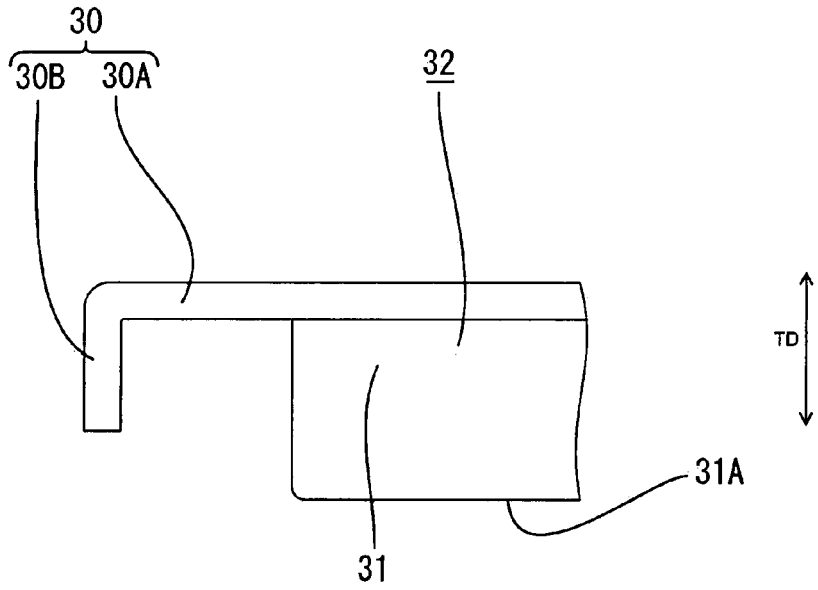
FIG. 6 is a partial enlarged plan view of a fixing bracket showing the shape of an engaging portion according to a second embodiment.

A second embodiment of the invention is illustrated in FIG. 6. This embodiment differs from the first embodiment in the shape of each engaging portion 30 in which a projection 30A and a folded portion 30B do not adhere to or contact each other. This engaging portion 30 is substantially L-shaped by the projection 30A and the folded portion 30B. The folded portion 30B projects up to a position more inward than the position of a projecting end 31A of a solder portion 31, and the entire thickness of a fixing bracket 32 is suppressed to that of a fixing bracket in which an engaging portion is not bent.

Figure 7:
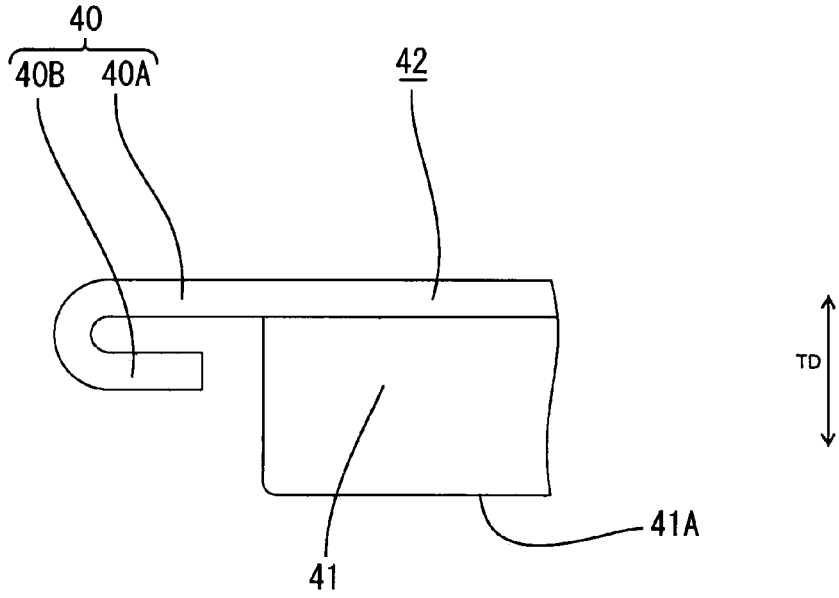
FIG. 7 is a partial enlarged plan view of a fixing bracket showing the shape of an engaging portion according to a third embodiment.

A third embodiment of the invention is illustrated in FIG. 7. This embodiment differs from the first embodiment in the shape of each engaging portion 40 in which a projection 40A and a folded portion 40B do not adhere to or contact each other. This engaging portion 40 is substantially U-shaped or bent by the projection 40A and the folded portion 40B. The folded portion 40B projects up to a position more inward than the position of a projecting end 41A of a solder portion 41, and the entire thickness of a fixing bracket 42 is suppressed to that of a fixing bracket in which an engaging portion is not bent.

Figure 8:
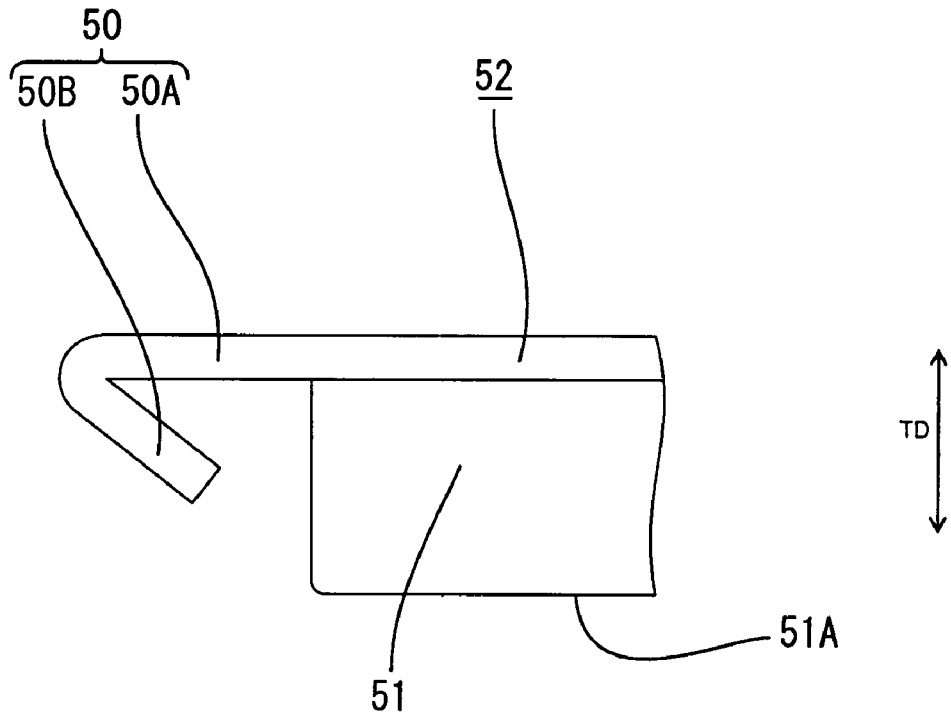
FIG. 8 is a partial enlarged plan view of a fixing bracket showing the shape of an engaging portion according to a fourth embodiment.

A fourth embodiment of the invention is illustrated in FIG. 8. This embodiment differs from the first embodiment in the shape of each engaging portion 50 in which a projection 50A and a folded portion 50B do not adhere to or contact each other. This engaging portion 50 is substantially V-shaped by the projection 50A and the folded portion 50B. The folded portion 50B projects up to a position more inward than the position of a projecting end 51A of a solder portion 51, and the entire thickness of a fixing bracket 52 is suppressed to that of a fixing bracket in which an engaging portion is not bent.

The invention is not limited to the above described and illustrated embodiments. For example, the following embodiments are also embraced by the technical scope of the present invention as defined by the claims.

Pairs of front and rear engaging portions are provided in the above foregoing embodiments. However, the invention is not limited thereto and the engaging portions may be provided at only one of the front and rear ends.

Although the folded portions are folded towards the same sides as the solder portions project in the above foregoing embodiment, the invention is not limited thereto and the folded portions may be folded towards a side opposite to the solder portions. However, this results in a slight increase in the thickness of the entire fixing brackets.

The engaging portions are folded at the projecting ends thereof in the foregoing embodiments. However, the invention is not limited thereto and it does not matter how the engaging portions are folded provided that the areas of the engaging surfaces increase in the thickness direction of the engaging portions. For example, the engaging portions may be folded in a zigzag manner to alternately arrange peaks and troughs along their projecting directions.

What is claimed is:

1. A connector to be connected to a device, comprising:

a housing, at least one mount groove formed in the housing and extending along an insertion direction, at least one restricting surface formed in the mount groove and aligned at an angle to the insertion direction;

at least one fixing member made of a metallic plate material and having a main body mountable in the mount groove in the housing, the fixing member further having a solder portion bent from a bottom end of the main body in an outward direction relative to the housing and disposed to be fixed to the device, at least one engaging portion formed on the fixing member and having a bottom end disposed for contacting the restricting surface of the mount groove for restricting displacement of the engaging portion in the insertion direction, the engaging portion being bent in the outward direction to increase an area of the bottom end of the engaging portion without exceeding a combined dimension of the main body and the solder portion in the outward direction.

2. The connector of claim 1, wherein the engaging portion is bent at a projecting end position so that all of the engaging portion is located more inward than a projecting end of the solder portion.

3. The connector of claim 1, wherein the engaging portion is folded so that two parts are substantially in surface contact with each other.

4. The connector of claim 1, wherein the engaging portion is bent to be substantially L-, V or U-shaped.

5. The connector of claim 1, wherein the housing has at least one narrowing portion for narrowing the width of the respective mount grooves in forward and backward directions.

6. The connector of claim 5, wherein the fixing bracket has at least one retaining portion for gradually biting in the narrowing portions as the fixing bracket is inserted into the mount groove for holding the fixing bracket in the housing.

7. The connector of claim 1, wherein the at least one mount groove is formed in a side surface of the housing so that a plate surface of the fixing member extends substantially along the side surface of the housing.

8. The connector of claim 7, wherein at least part of the engaging portion of the fixing member extends along the side surface of the housing at front or rear edges of the fixing member.

9. The connector of claim 7, wherein at least one the solder portion projects substantially normal to the side surface of the housing.

10. The circuit connector of claim 9, wherein the fixing member is fixed to the device by soldering the solder portion to the outer surface of the device.

11. A circuit board connector to be connected to a circuit board, comprising:

a housing having a bottom for mounting in opposed relation to the circuit board, a top opposite the bottom and opposite first and second side surfaces extending between the top and bottom, mount grooves formed in the side surfaces of the housing and extending along an insertion direction from the top to the bottom, front and rear restricting surfaces formed in each of the mount grooves, the restricting surfaces aligned substantially normal to the insertion direction and facing away from the bottom of the housing; and first and second fixing members made of a metallic plate material and being mounted respectively in the mount grooves, each of the fixing members having a substantially planar main body, a solder portion bent angularly out from a bottom end of the main body and in a direction away from the housing for connection to the circuit board, front and rear projections extending from the main body and bent parts bent from ends of the respective projections spaced from the main body and bent out in the direction away from the housing, bottom edges extending along the projections and the bent parts and contacting the restricting surface of the mount groove for restricting displacement of the engaging portion in the insertion direction, the bent parts increasing a contact area with the restricting surface of the mount groove without exceeding a combined dimension of the main body and the solder portion in directions away from the housing.

12. The connector of claim 11, wherein each of the projections and the respective bent part are at least partly in surface to surface contact.

13. The connector of claim 11, wherein each of the projections and the respective bent part define a V-shape.

14. The connector of claim 11, wherein each of the projections and the respective bent part define a L-shape.

* * * * *